US005389308A

United States Patent [19]

Busel et al.

[11] Patent Number: 5,389,308

[45] Date of Patent: Feb. 14, 1995

[54] COMPOSITION GENERATING AN IR-OPAQUE SMOKE

[75] Inventors: Horst Busel, Berchtesgaden; Joseph Schneider, Bischofswiesen, both of Germany

[73] Assignee: Buck Werke GmbH & Co., Bad Uberkingen, Germany

[21] Appl. No.: 110,555

[22] Filed: Aug. 20, 1993

[51] Int. Cl.[6] ..... F21V 9/04; C06D 3/00; C06B 27/00

[52] U.S. Cl. ..... 252/587; 102/334; 149/87

[58] Field of Search ..... 149/87; 102/334; 252/587, 582

[56] References Cited

U.S. PATENT DOCUMENTS

| | | | |
|---|---|---|---|
| 3,576,754 | 4/1971 | Lehikoinen | 252/700 |
| 3,690,971 | 9/1972 | Gunderloy et al. | 149/19 |
| 3,695,949 | 10/1972 | Freeman et al. | 149/15 |
| 4,697,521 | 10/1987 | Espagnacq et al. | 102/334 |
| 4,698,108 | 10/1987 | Vega et al. | 149/87 |
| 4,704,966 | 11/1987 | Sellman et al. | 102/334 |
| 4,724,018 | 2/1988 | Espagnacq et al. | 149/87 |
| 4,728,375 | 3/1988 | Simpson | 149/5 |

FOREIGN PATENT DOCUMENTS

| | | |
|---|---|---|
| 2089816 | 1/1972 | France . |
| 2560186 | 8/1985 | France . |
| 2556256 | 6/1977 | Germany . |
| 4030430 | 12/1993 | Germany . |

*Primary Examiner*—Philip Tucker

[57] ABSTRACT

A composition generating an IR-opaque smoke in the form of a compact which has a density in the range from 0.9 to 1.5 g/cm$^3$ is described, comprising from 10 to 25 percent by weight of magnesium powder, from 5 to 35 percent by weight of a fluorinated organic poller, from 5 to 15 percent by weight of chloroparaffin and from 35 to 65 percent by weight of an aromatic compound of the formula I

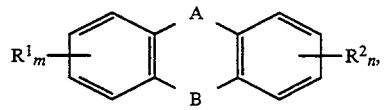

(I)

wherein A and B are independently selected from

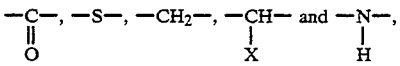

$R^1$ and $R^2$ are independently selected from OH, X or alkyl having one to four carbon atoms, m and n is an integer from 0 to 2, and X is halogen, or an aromatic compound of formula II

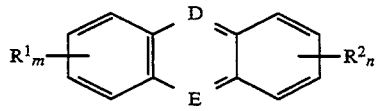

(II)

wherein $R^1$ and $R^2$ X m and n are defined as above and D and E are independently selected from

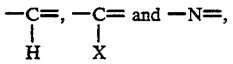

or phtalic anhydride, 2-benzoyl pyridine, fluorene, dibenzosuberenone or diphenylenesulphide or the derivatives thereof substituted by $R^1_m$ and/or $R^2_m$.

20 Claims, No Drawings

COMPOSITION GENERATING AN IR-OPAQUE SMOKE

The invention relates to a composition generating an IR-opaque smoke.

In the technical field of reconnaissance, target location, target tracking and arms technology, IR sensors are increasingly used which are capable of making the entire battlefield transparent up to far into the opponents' area. An effective method of neutralising or obstructing the effect of the IR sensors consists in cutting off the line of sight by smoke systems. The effect of these smoke systems is based on the fact that the particles forming the smoke scatter and/or absorb the incident infrared radiation, the scattering effect then being strongest if the effective diameter of the particles and the wavelength of the incident electromagnetic radiation are approximately equal. Modern IR sensors are effective in the range from 0.8 to 14 μm. Hitherto there was the problem that particles having diameters in this range settle very rapidly and effective smoke screens cannot be produced. The use of hexachloroethane and red phosphorus for generating smoke was already known. The aerosols produced therefrom are liquid aerosols which are able to remain floating in the atmosphere. However, they have too small a specific surface area and particle size and therefore can absorb or scatter electromagnetic radiation only in the visible range, i.e. at a wavelength from 0.4 to 0.7 μm, but not in the IR range. In contrast, solids aerosols combine a large relative surface area with a microscopically fine distribution. Very small particles having a diameter from $10^{-3}$ μm to 1 μm do not settle over prolonged periods if they are dispersed in a gas volume, but are maintained in the gas space by Brownian molecular motion and the viscosity of the carrier gas. In the case of particles having a diameter of 10 μm and more, the molecular motion can no longer compensate for the effect of gravity, and the particles settle. This means that preformed solids aerosols such as, for example, brass or copper dust are unsuitable as active components for a smoke-generating composition, as the particles settle rapidly and can no longer be swirled up from the ground, or after they have been discharged are immediately blown away by air movements.

In DE-A 3,326,883 it is proposed, in order to solve this problem, to use a solids aerosol for screening infrared rays in which particles of soot are generated by thermal decomposition. The compounds used which generate soot particles are, in particular, chlorinated aromatic compounds, inter alia the highly toxic hexachlorobenzene. This known composition provides soot particles having a particle diameter in the range from a few μm up to millimeter-sized flakes. This system is not very effective in the infrared range, though.

To provide effective protection against IR homing heads and laser-guided homing heads and thermal-image reconnaissance, a smoke screen has to be generated which has a distance from the object to be protected of at least approximately 30 m and can cover an area in the range of a width of 100 m and a height of 10 m. Moreover, after activation of the smoke-forming composition the smoke should be generated within 10 seconds and then have a lifetime of up to at most 60 seconds. The smoke must emit and absorb IR and be made up in such a way that it covers wavelengths in the range from 0.4 to 14 μm.

The object of the invention therefore is to provide a composition with which a smoke can be generated which, on the one hand, is opaque to IR and laser rays and, on the other hand, has a sufficiently long lifetime.

This object is achieved by means of a composition generating an IR-opaque smoke in the form of a compact which has a density in the range from 0.9 to 1.5 g/cm$^3$, comprising from 10 to 25 percent by weight of magnesium powder, from 5 to 35 percent by weight of a fluorinated organic polymer, from 5 to 15 percent by weight of chloroparaffin and from 35 to 65 percent by weight of an aromatic compound of formula I

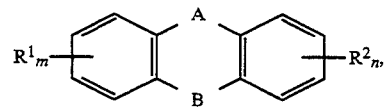

(I)

wherein A and B are independently selected from

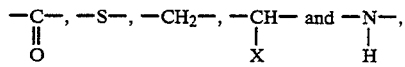

$R^1$ and $R^2$ are independently selected from OH, X or alkyl having one to four carbon atoms, m and n is an integer from 0 to 2, and X is halogen, or an aromatic compound of formula II

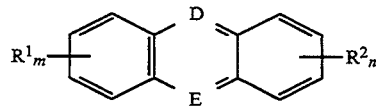

(II)

wherein $R^1$ and $R^2$ X m and n are defined as above and D and E are independently selected from

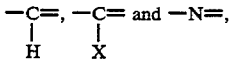

or phtalic anhydride, 2-benzoyl pyridine, fluorene, dibenzosuberenone or diphenylenesulphide or the derivatives thereof substituted by $R^1{}_m$ and/or $R^2{}_m$.

This composition, when activated in a conventional manner, for example by pyrotechnic ignition, results in the formation of an aerosol whose particle size is in the desired range and whose lifetime is up to one minute. The composition according to the invention acts both as an IR absorber and as an emitter. In contrast to the smoke agents used previously, hexachloroethane and phosphorus which are in the form of liquid aerosols, solids aerosols are generated according to the invention.

In order to keep the smoke particles in the atmosphere over a prolonged period, according to the invention the solids aerosol is generated in situ by a pyrotechnic reaction, so that the smoke is replenished from the ground for as long as the pyrotechnic reaction continues.

The composition according to the invention contains the components necessary for aerosol generation in situ in the form of an aerosol supplier, an energy supplier and a combustion moderator which at the same time serves as a binder. Only if these three components are in an optimum proportion to one another, is a smoke generated which has the desired properties. An essential factor for the effect of the aerosol formed with respect to electromagnetic radiation in the IR range is a parameter defined as mass extinction coefficient. This parameter expresses the capacity of the aerosol to attenuate the electromagnetic radiation. The mass extinction coefficient is defined as $\alpha = \ln T{:}x{\cdot}c$, where ln T is the natural logarithm of the transmission, x is the thickness of the aerosol screen in m and c is the aerosol concentration in g per $m^3$. Only if the $\alpha$ values are $\geqq 1$ $m^2$ per gram, can an effect be expected in the IR range. The smoke-generating agents known hitherto have $\alpha$ values which in some cases are far below 1.

The mass extinction coefficient is related to the agents used as aerosol suppliers and to the combustion rate. If the pyrotechnic reaction is such that the combustion rate is in the range of 15 g per second, the desired mass extinction coefficient of between 1.0 and 1.8 is achieved. If the reaction rate is too high, finely particulate soot is produced which is not suitable for the absorption of electromagnetic radiation in the IR range. If the combustion rate becomes too low, large flakes are produced which are not optimally effective either in the IR range. This combustion rate can be achieved if the composition according to the invention is used. To this end, the energy supplier used is a mixture of magnesium powder and a fluorinated organic polymer, said two substances being used preferably in approximately equal amounts up to a weight ratio of 3:1, and particularly preferably being used in a ratio of 1.5 to 2:1.

The magnesium powder used for the composition according to the invention should be as finely particulate as possible, as the activity rises with the size of the specific surface area. Preferably, a magnesium powder is used in which more than 90 percent by weight has a particle size less than 63 $\mu$m.

The fluorinated organic polymer supplies the other component of the energy-supplying reaction in which the reaction of magnesium with fluorine releases energy. The fluorinated organic polymer used can be chosen from the commercially available fluorinated aliphatic and aromatic hydrocarbons. In particular, polytetrafluoroethylene and polyvinylidene fluoride are suitable.

In order to control the energy-supplying reaction, a combustion moderator is added as a further component, with the aid of which the combustion temperature of the energy supplier can be controlled and kept constant. A chloroparaffin is used for this purpose. Chloroparaffins are chlorinated aliphatic hydrocarbons. The commercially available chloroparaffins usually consist of mixtures of compounds having carbon skeletons of different lengths and different degrees of chlorination. For processing reasons, a chloroparaffin is preferably used according to the invention, which is solid at the processing temperature. Preferably, chloroparaffin having a relatively high chlorine content, particularly preferably having a chlorine content of more than 60 percent by weight, is used.

The third essential component of the composition according to the invention is the aerosol supplier. According to the invention, the aromatic compound used is an aromatic compound of formula I

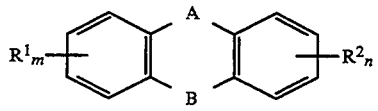

(I)

wherein A and B are independently selected from

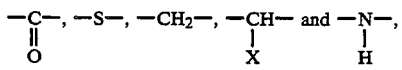

$R^1$ and $R^2$ are independently selected from OH, X or alkyl having one to four carbon atoms, m and n is an integer from 0 to 2, and X is halogen, or an aromatic compound of formula II

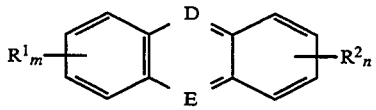

(II)

wherein $R^1$ and $R^2$, X, m, and n are defined as above and

D and E are independently selected from

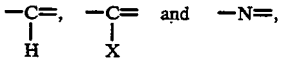

or phtalic anhydride, 2-benzoyl pyridine, fluorene, dibenzosuberenone or diphenylenesulphide or the derivatives thereof substituted by $R^1{}_m$ and/or $R^2{}_m$.

As a result of the energy liberated in the pyrotechnic reaction, the compounds of the aerosol supplier give rise, by decarbonylation, decarboxylation, desulphurisation etc., to dehydrobenzene which is very reactive and rearranges immediately to form a benzene diradical, which in turn reacts with further radicals to give ribbon- or net-like meshes. These polymers are the active substances of the aerosol according to the invention. They constitute a mixture which aggregates to form agglomerates which have a fibrous novel structure and, owing to the CO and $CO_2$ produced in the reaction, are highly porous and fissured. Therefore, these particles have a very large specific surface area which is highly advantageous for their function. Suitable aromatic compounds are, inter alia, anthracene, anthraquinone, alizarine, acridine, anthrone, 8-bromoanthracene, thianthrene, thioxanthrone, thiodiphenylamine, phenazine, dihydroanthracene, 2-chlorothiodiphenylamine, phthalic anhydride, fluorene, 2-benzoylpyridine, dibenzosuberenone or diphenylenesulphide. As the toxicity of aromatic halogenated hydrocarbons is very high in some cases, those compounds are preferred as aerosol suppliers which have no halogen atoms in their structure. A further aspect in the selection of the aerosol supplier is the availability which, in particular for the compounds phthalic anhydride, anthracene and anthraquinone, is especially high, so that these compounds are preferred on economic grounds for the composition according to the invention. It is also possible to use, for the composition according to the invention, mixtures of various compounds of the formula I.

The various components of the composition according to the invention are used in such amounts that from 10 to 25 percent by weight, preferably from 15 to 20 percent by weight of magnesium powder, from 5 to 35 percent by weight, preferably from 10 to 30 percent by weight of the fluorinated polymer, from 5 to 15 percent by weight, preferably from 10 to 15 percent by weight of chloroparaffin, and from 35 to 65 percent by weight, preferably from 40 to 60 percent by weight of the aromatic compound serving as the aerosol supplier are present.

The individual components are mixed in a conventional manner and are then compacted. Preferably, the mixture containing the components necessary according to the invention is compression-moulded into a container, for example an aluminium container. The mixture is compression-moulded with such a pressure that a body is produced which has a density in the range from 0.9 to 1.5 g per $cm^3$, preferably from 1.1 to 1.4 $g/cm^3$. This is because it was found, surprisingly, that the density of the composition according to the invention is a significant parameter by which the combustion rate and thus the particle size of the aerosol supplier are affected. Only if the moulding has a density in the range stated, is the particle size range from 1 to 15 $\mu$ covered upon combustion. If the density is too high, the combustion rate is increased so as to produce only finely particulate soot which cannot meet the objective posed.

The composition according to the invention may in addition contain an IR-emitting component, which begins to act virtually immediately after ignition and whose effect lasts until the effect of the composition according to the invention starts. Systems of this type are known to those skilled in the art. Typical compositions of this type contain, for example, 25 % of a fluorine-containing polymer, 25 % of magnesium and 50 % of an organic compound.

The ignition of the composition is effected in a conventional manner, in which the composition according to the invention may, for example, be ignited by means of an ignition charge which, for example, contains $Si/Pb_3O_4$ or an equivalent pyrotechnic mixture, while the ignition of the IR-emitting composition is effected by an ignition/disintegration charge in which ignition and disintegration take place simultaneously, for example $Ba(NO3)_2$.

According to the invention, a composition is provided which generates an IR-opaque smoke which fully meets the requirements posed and in which the use of toxic components is not required.

The invention is explained by the following examples:

EXAMPLE 1

180 g of magnesium powder having a screen analysis of ≦10% over 71 $\mu$m, ≦60% over 40 $\mu$m, ≧30% over 25 $\mu$m, remainder under 25 $\mu$m, and 240 g of Hostaflon TF 9202 (polytetrafluoroethylene) were intensively mixed in a bowl. 480 g of aDthraquinone screened through a 1 millimeter screen were then added and again well mixed. Finally, 100 g of chloroparaffin having a degree of chlorination of 70 percent by weight and an average molecular weight of 516 were added and once more mixed intensively. The powder mixture was then compression-moulded into a container of from 50 to 80 mm to a density of from 1.1 to 1.4 $g/cm^3$.

EXAMPLE 2

According to the method of Example 1, the following composition was prepared: Hostaflon TF 1640 (polytetrafluoroethylene), 10 percent by weight; magnesium powder (as in Example 1), 20 percent by weight; anthraquinone, 60 percent by weight; chloroparaffin (as in Example 1), 10 percent by weight.

EXAMPLE 3

Using the method of Example 1, the following composition was prepared: Hostaflon TF 1640 (polytetrafluoroethylene), 10 percent by weight; magnesium powder (as in Example 1), 20 percent by weight; anthraquinone, 55 percent by weight; additionally chlorinated PVC, chlorine content 62%, 15 percent by weight.

EXAMPLE 4

Using the method of Example 1, the following composition was prepared: Hostaflon TF 9202 (polytetrafluoroethylene), 24 percent by weight; magnesium powder (as in Example 1), 18 percent by weight; fluorene, 48 percent by weight; chloroparaffin (as in Example 1), 10 percent by weight.

EXAMPLE 5

Using the method of Example 1, the following composition was prepared: Hostaflon TF 9202 (polytetrafluoroethylene), 20 percent by weight; magnesium powder (as in Example 1), 20 percent by weight; phthalic anhydride, 45 percent by weight; chloroparaffin (as in Example 1), 15 percent by weight.

EXAMPLE 6

Using the method of Example 1, the following composition was prepared: polyvinylidene fluoride having a fluorine content of 59 percent by weight (Vidar), 22 percent by weight; thiodiphenylamine, 48 percent by weight; polyvinylchloride, 10 percent by weight.

EXAMPLE 7

Using the method of Example 1, the following composition was prepared: polyvinylidene fluoride (as in Example 6), 30 percent by weight; magnesium powder (as in Example 1), 15 percent by weight; acridine, 40 percent by weight; chloroparaffin (as in Example 1), 15 percent by weight.

EXAMPLE 8

Using the method of Example 1, the following composition was prepared: polyvinylidene fluoride (as in Example 6), 30 percent by weight; magnesium powder (as in Example 1), 15 percent by weight; thianthrene, 40 percent by weight; chloroparaffin (as in Example 1), 15 percent by weight.

EXAMPLE 9

In order to test the effectiveness of the composition according to the invention in the spectral range from 1 to 14 $\mu$m, a smoke screen was generated which was to be suitable for the protection of armoured vehicles against thermal-image reconnaissance, IR homing heads and laser-guided homing heads. To this end, 8 smoke rounds were fired with angular fannings of 14°- 14°- 14°- 14°- 14°- 9°- 4°. The smoke rounds each contained a mixture of the composition according to the invention of Example 1 and a composition which generated a smoke within 2 seconds and contained 25% of fluorinated organic polymer, 25% of magnesium powder and 50% of phthalic anhydride. In doing so, the following results were obtained:

| Measured data | Target 1 | Mean value Targets 2 to 5 |
|---|---|---|
| Build-up time (VIS)/sec | 4 | |
| Lifetime (VIS)/sec | 79 | |
| Build-up time (IR)/sec | 7 | 7 |
| Lifetime (IR)/sec | 34 | 33 |
| Lifetime (IR)/lifetime (VIS) | 43% | 42% |
| Relative coverage (IR) | 95% | 100% |
| Decrease in contrast 8 to 14 μm | 91% | |
| Decrease in contrast 3 to 5 μm | 95% | |

Crosswind speed 3 m/s
Rel. air humidity 84%

We claim:

1. A composition for generating an IR-opaque smoke in the form of a compact which has a density in the range from 0.9 to 1.5 g/cm$^3$ and which comprises from 10 to 25 percent by weight of magnesium powder, from 5 to 35 percent by weight of a fluorinated organic polymer, from 5 to 15 percent by weight of chloroparaffin, and from 35 to 65 percent by weight of an aromatic compound selected from the group consisting of (a) compounds of the formula I

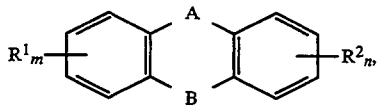

(I)

wherein A and B are independently selected from

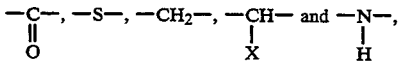

$R^1$ and $R^2$ are independently selected from OH, X or alkyl having one to four carbon atoms,
m and n is an integer from 0 to 2, and
X is halogen, (b) compounds having formula II

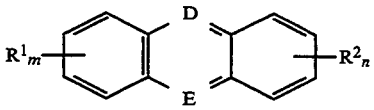

(II)

wherein $R^1$ and $R^2$, X, m, and n are defined as above and

D and E are independently selected from

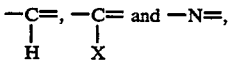

(c) compounds from the group of phthalic anhydride, 2-benzoyl pyridine, fluorene, dibenzosuberenone or diphenylenesulphide, and the derivatives thereof which are substituted by $R^1_m$ $R^2_m$, and combinations thereof.

2. A smoke generating composition according to claim 1, containing from 15 to 20 percent by weight of magnesium powder, from 10 to 30 percent by weight of fluorinated organic polymer, from 10 to 15 percent by weight of chloroparaffin, and from 40 to 60 percent by weight of aromatic compound.

3. A smoke generating composition according to claim 1, wherein the ratio of magnesium powder to fluorinated organic polymer is from 1.5 to 2:1.

4. A smoke generating composition according to claim 1 wherein more than 90 percent of the magnesium powder has a particle size less than 70 micrometers.

5. A smoke generating composition according to claim 1 wherein the fluorinated organic polymer is selected from the group consisting of polytetrafluoroethylene, polyvinylidene fluoride, and mixtures thereof.

6. A smoke generating composition according to claim 1 wherein the aromatic compound is free from halogen atoms as substituents.

7. A smoke generating composition according to claim 1 wherein the aromatic compound is phthalic anhydride, anthracene or anthraquinone.

8. A smoke generating composition according to claim 1 wherein the chloroparaffin has a degree of chlorination is above 60 percent by weight.

9. A smoke generating composition according to claim 1 wherein the density of the compact is in the range from 1.1 to 1.4 g/cm$^3$.

10. A composition for generating an IR-opaque smoke in the form of a compact which has a density in the range from 0.9 to 1.5 g/cm$^3$ and which comprises from 10 to 25 percent by weight of magnesium powder, from 5 to 35 percent by weight of a fluorinated organic polymer, from 5 to 15 percent by weight of chloroparaffin, and from 35 to 65 percent by weight of an aromatic compound selected from the group consisting of (a) compounds of the formula I

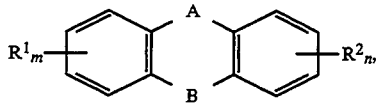

(I)

wherein A and B are independently selected from

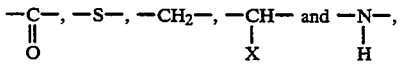

$R^1$ and $R^2$ are independently selected from OH, X or alkyl having one to four carbon atoms,
m and n is an integer from 0 to 2, and
X is halogen, (b) compounds having formula II

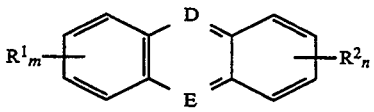

(II)

wherein $R^1$ and $R^2$, X m, and n are defined as above and D and E are independently selected from

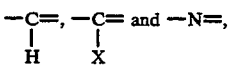

(c) compounds from the group of phthalic anhydride, 2-benzoyl pyridine, fluorene, dibenzosuberenone or diphenylenesulphide, and the derivatives thereof which are substituted by $R^1_m$ $R^2_m$, and combinations thereof, the ratio of magnesium powder to fluorinated organic polymer being from 1.5 to 2:1 and more than 90 percent of the magnesium powder having a particle size less than 70 micrometers.

11. A smoke generating composition according to claim 10, containing from 15 to 20 percent by weight of magnesium powder, from 10 to 30 percent by weight of fluorinated organic polymer, from 10 to 15 percent by weight of chloroparaffin, and from 40 to 60 percent by weight of aromatic compound.

12. A smoke generating composition according to claim 10 wherein the fluorinated organic polymer is selected from the group consisting of polytetrafluoroethylene, polyvinylidene fluoride, and mixtures thereof.

13. A smoke generating composition according to claim 10 wherein the aromatic compound is free from halogen atoms as substituents.

14. A smoke generating composition according to claim 10 wherein the aromatic compound is phthalic anhydride, anthracene or anthraquinone.

15. A smoke generating composition according to claim 10 wherein the chloroparaffin has a degree of chlorination is above 60 percent by weight.

16. A smoke generating composition according to claim 10 wherein the density of the compact is in the range from 1.1 to 1.4 g/cm$^3$.

17. A composition for generating an IR-opaque smoke in the form of a compact which has a density in the range from 0.9 to 1.5 g/cm$^3$ and which comprises from 10 to 25 percent by weight of magnesium powder, from 5 to 35 percent by weight of a fluorinated organic polymer selected from the group consisting of polytetrafluoroethylene, polyvinylidene fluoride, and mixtures thereof, from 5 to 15 percent by weight of a chloroparaffin, and from 35 to 65 percent by weight of an aromatic compound selected from the group consisting of (a) compounds of the formula I

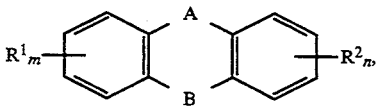

(I)

wherein A and B are independently selected from

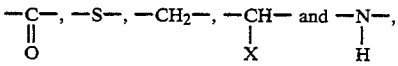

$R^1$ and $R^2$ are independently selected from OH, X or alkyl having one to four carbon atoms, m and n is an integer from 0 to 2, and X is halogen, (b) compounds having formula II

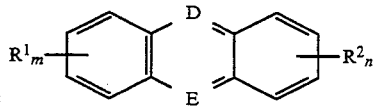

(II)

wherein $R^1$ and $R^2$, X, m, and n are defined as above and

D and E are independently selected from

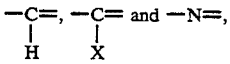

(c) compounds from the group of phthalic anhydride, 2-benzoyl pyridine, fluorene, dibenzosuberenone or diphenylenesulphide, and the derivatives thereof which are substituted by $R^1{}_m$, $R^2{}_m$, and combinations thereof, said aromatic compound being free from halogen atoms as substituents.

18. A smoke generating composition according to claim 17, containing from 15 to 20 percent by weight of magnesium powder, from 10 to 30 percent by weight of fluorinated organic polymer, from 10 to 15 percent by weight of chloroparaffin, and from 40 to 60 percent by weight of aromatic compound.

19. A smoke generating composition according to claims 17, wherein the ratio of magnesium powder to fluorinated organic polymer is from 1.5 to 2:1, and the more than 90 percent of the magnesium powder has a particle size less than 70 micrometers.

20. A smoke generating composition according to claim 17 wherein the aromatic compound is phthalic anhydride, anthracene or anthraquinone.

* * * * *